United States Patent [19]

Bender et al.

[11] 3,970,526

[45] July 20, 1976

[54] CLOSED TANK COKE CAR CONSTRUCTION

[75] Inventors: Martin Bender, Dusseldorf; Johannes Knappstein; Josef Stratmann, both of Recklinghausen, all of Germany

[73] Assignees: Firma Carl Still, Firma Hartung, Kuhn & Co. GmbH; both of Germany

[22] Filed: Aug. 6, 1974

[21] Appl. No.: 495,204

[30] Foreign Application Priority Data

Aug. 9, 1973 Germany ..... 2340256

[52] U.S. Cl. ..... 202/227; 202/230; 202/253; 202/95; 105/240; 105/247; 105/423

[51] Int. Cl.[2] ..... C10B 39/14

[58] Field of Search ..... 202/230, 227, 253, 95; 105/254, 240, 247, 250; 214/35

[56] References Cited

UNITED STATES PATENTS

| | | | |
|---|---|---|---|
| 1,105,948 | 8/1914 | Wright | 105/254 |
| 3,715,282 | 2/1973 | Pries et al. | 202/227 XR |
| 3,843,461 | 10/1974 | Allen | 202/227 |

FOREIGN PATENTS OR APPLICATIONS

| | | | |
|---|---|---|---|
| 839,789 | 5/1952 | Germany | 105/254 |
| 830,469 | 3/1960 | United Kingdom | 105/254 |

*Primary Examiner*—James H. Tayman, Jr.
*Attorney, Agent, or Firm*—McGlew and Tuttle

[57] ABSTRACT

A coke oven discharge device for the closed discharge of coke from a horizontal row of coke ovens into a receiving bunker located alongside the ovens comprises a support frame which is mounted on an undercarriage for movement along a path alongside the rows of coke ovens. The tank is made up of a plurality of heat resistant metal plates which are suspended in loosely adjacent layers from strips and they overlap their adjacent plates. The tank includes a bottom with openable door means for selectively opening and closing a bottom discharge for discharging the coke into a receiving bunker. A separator and washer is connected to the tank for withdrawing gaseous dust and odors and for subjecting them to a washing and a removal of the dust. The tank carries a sealing sleeve which is engageable between the exterior of the tank around the bottom discharge and a bunker to seal the space therebetween during the discharge.

10 Claims, 5 Drawing Figures

CLOSED TANK COKE CAR CONSTRUCTION

BACKGROUND OF THE INVENTION

1. Field of the Invention

This invention relates in general to the construction of coke ovens and in particular to a new and useful closed tank car for transporting incandescent coke from the oven chambers to a quenching station.

2. Description of the Prior Art

The present invention relates particularly to the construction of a closed tank car which is capable of transporting coke from each of a plurality of horizontally arranged coke ovens in succession to a receiving bunker. Various designs of such tank cars have been proposed for the emission free pushing, receiving and transportation and wet quenching of the coke in a quenching tower after it is pushed out from horizontal coke ovens to the receiving tank car. The known constructions include a coke box which travels in front of the coke oven battery on a track and is positionable tightly close to a door frame of the oven chambers and is made approximately to the dimensions of a cake to be received. Such devices usually include a bottom door discharge and it is movable toward a stationary coke bunker located in a zone of a track defined alongside the coke oven battery. Such devices usually include a coke quenching chamber connected thereto which includes a chimney and the coke box is provided with a double wall construction with gas evacuation spaces therebetween. In a known construction the inner wall is made of perforated sheets or iron slats with gas evacuation spaces therebetween and the outer walls are massive and include conduits for the quenching liquid. The quenching fumes collect in a space above the coke box and this space is connected to a dust separating device. Liftable and lowerable side plates are provided on the outer walls of the coke box which are lowerable into a seal channel running around the upper opening of a coke bunker for connecting the device to the bunker for discharge. Many other types of devices are known for carrying away the coke cake and some of them include gas tight fittings so that the gases do not escape and they are associated with means for quenching the coke and for separating the gases. At locations where the portions of these cars come into contact with the incandescent coke they are frequently coated with refractory materials such as refractory bricks. This is a disadvantage inasmuch as it makes them heavy in an unfavorable manner. Because of their high weight and clumsiness all of the known devices are inappropriate for the numerous operations in modern heavy duty coking plants with large volume chambers.

The tank cars without a refractory coating have the disadvantage that they are not made of a material which would permanently withstand the stresses of the temperature variations nor are they constructed so that the parts can follow the thermal expansion and contraction without hindering one another to create distortions in tightness between the individual parts and the closures. In such cases, dust and unpurified gases and fumes escape in an uncontrollable manner and cannot be caught and cleaned prior to their passing into the outer atmosphere.

SUMMARY OF THE INVENTION

The present invention provides a new closed tank car of the type which is movable along the rows of coke ovens and which is able to receive the coke cake without escape of gases and dust and to deliver the cake into a bunker again without any escape of gases and dust. The car is constructed of plates which are overlapped and fitted together so that they will not become untight by distortion even in permanent operation. The closures will remain tight so that no dust or unpurified gases and fumes can escape and pollute the atmosphere. The construction nevertheless may be made without requiring refractory coatings or brick linings so that the car may be of relatively small weight.

The invention includes a tank car having a vertically extending hood portion with an opening laterally for receiving the incandescent coke and the tank is supported by an undercarriage so that the plates are suspended within the frame of the undercarriage. The tank is constructed of heat resistant metal plates which are suspended in loosely adjacent layers from strips and which overlap one another on all sides. The construction includes a vertically extending hood portion which is also tightly closed to the tank and is capable of sealing the space with the coke oven for receiving the dust gases and fumes and is also designed as a heat resistant frame steel structure. The overlapped metal plates of the hood portion are clamped to clamp strips in the frame carried by the undercarriage engaging and holding the plates so that they are suspended therefrom. The tank car of the invention is such that the plates of the tank and the hood can follow the thermal expansion caused by the effect of the incandescent coke and they may easily contract again without hindrance as soon as the coke is discharged, or in an emergency when quenching with water takes place. The extension of the hood in length can amount to 40 mm. Experience has shown in the construction of the inventive tank car that no distortion of the individual component parts takes place and in a permanent operation even the closures of the car remain tight.

The plates of the tank walls are preferably made of cast iron or hematite. They are advantageously provided on their exterior with cooling ribs or attached pieces. For the covering of the hood portion, plates of a chromium steel alloy containing from 10 to 15 and preferably from 12 to 14% of chromium may be advantageously used. Such a material having 13.5% of chromium is available on the market under the name "Thermax" and it withstands permanent temperatures of 950°C.

In accordance with a feature of the construction the lateral coke entrance opening which is provided in the hood portion may be opened manually or with the aid of a drive motor. The closure comprises one or two wings or doors which are pivotable about vertical axes and disposed so that in the case of need they may be pushed open by the coke passing through the coke guide car. After the coke is received within the hood they close mechanically or manually in case the motor drive of the closure is not operative for one reason or another. The vertical pivots are screened against the effect of heat and the wings are coated with sheets in the same manner as the hood walls.

The tank includes a bottom with a lower coke discharge opening which is advantageously designed as a hydraulically closable hinge cover which in its closed position is secured by hydraulically actuated locking members. After the locking the hydraulic cylinders of the hinge cover are made pressureless. If for opening the hinged cover, the locking members are swung back, the hinged cover due to its own weight swings spontaneously open up to its stop. Thus a very rapid discharge of the coke from the tank car into the bunker is effected.

Induced draught blowers for the evacuation of dusts, gases and fumes from the hood are dimensioned so that they collect and evacuate all occurring dust but at the same time they draw as little combustion air as possible to burn up the coke. A specific suction capacity of from 400 to 600 $Nm^3$ per hour and ton of incandescent coke has proved appropriate and sufficient.

In order to obtain a uniform distribution of the incandescent coke in the tank of the car it may be advantageous depending on the nature of the carbonized coal, to provide a plowlike distribution arm in the middle of the tank at the bottom level of the coke guide car.

For those cases where the quenching station because of disturbance cannot receive the incandescent coke from the tank car, water pipes are provided in or around the hood and in or around the tank for the incandescent coke. Such water pipes are equipped with spray nozzles directed toward the interior of the tank and the water pipes are adapted to be connected to the water system of the plant. Experience in operation has shown that with the aid of this equipment a complete emergency quenching of the coke charge in the tank can be effected without damaging the tank car or its mechanisms for closing, opening, evacuating and washing of the waste gases.

Accordingly it is an object of the invention to provide an improved device for discharging coke from individual ovens of a horizontal coke oven battery which includes a car movable along the battery ovens and which has an upwardly extending hood portion with a laterally openable receiving opening for receiving the coke cake and which includes a separator for withdrawing the gases and dusts and for separating them and treating them with a washing liquid and which further includes a tank below the hood portion constructed of overlapped steel plates and which is suspended on a frame of a movable carriage and to an improved construction for opening and closing the bottom of the tank and the lateral entrance to the hood.

A further object of the invention is to provide a closed tank car for transporting incandescent coke from coke oven chambers which is simple in design, rugged in construction and economical to manufacture.

For an understanding of the principles of the invention, reference is made to the following description of a typical embodiment thereof as illustrated in the accompanying drawings.

GENERAL DESCRIPTION OF THE PREFERRED EMBODIMENT

Figure 1:
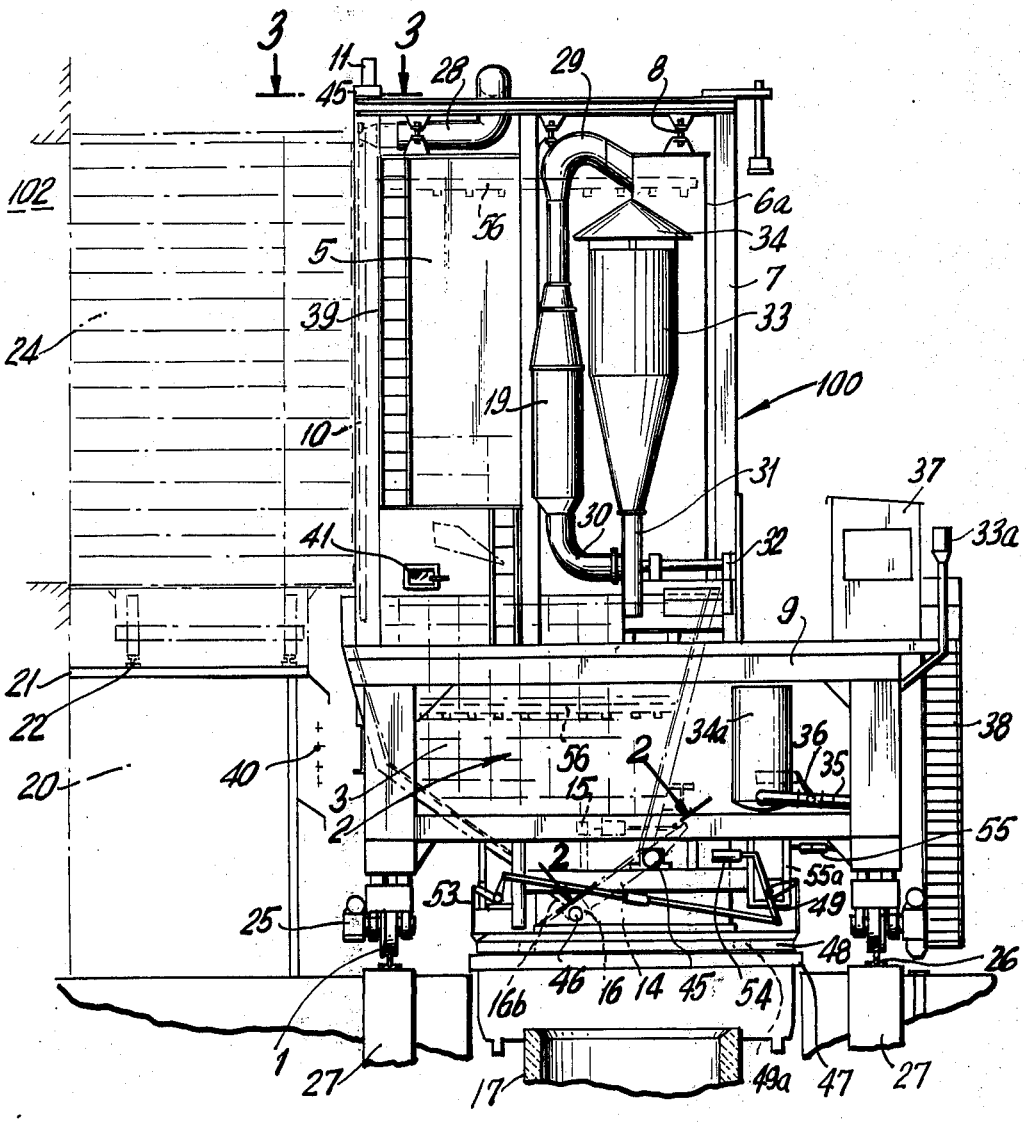
FIG. 1 is a side elevational view partly in section of the side of a coke oven furnace having a closed tank car constructed in accordance with the invention.
Figure 2:
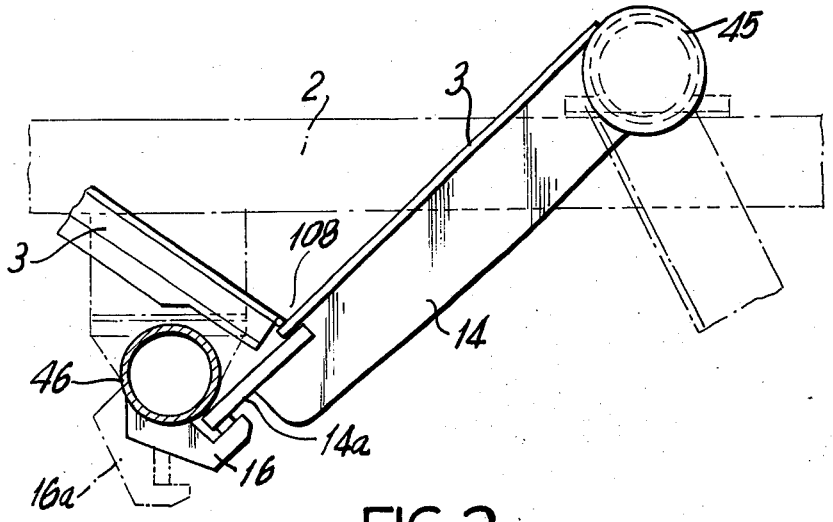
FIG. 2 is an enlarged partial sectional view taken along the line 2—2 of FIG. 1.

Referring to the drawings in particular the invention embodied therein comprises a coke oven discharge device generally designated 100 which is provided for the closed discharge of coke from individual coke ovens 102 of a battery of coke ovens arranged in a horizontal row.

A master gangway 20 extends along the length of the coke oven battery and it is provided with a roof 21. Trolley wires 40 extend along the length thereof for providing an electric source for driving a trolley or coke cake guidance carriage 24 having wheels which ride over a trackway or rails 22.

In accordance with the invention the coke oven discharge device comprises a tank car which includes a coke tank 2 having a vertical hood portion 5 and which is supported on an undercarriage 9 having wheels 1 which are guided over a track 26 which extends parallel to the track 22. The tank car is driven by a motor drive 25 to run the car over the rails 26 which are mounted on supports 27.

In accordance with a feature of the invention dust and gas separating means and washing means in the form of a separator 19 is connected through a suction connection 29 to the top of the hood portion 5. The equipment includes piping 28 of a suction and wash equipment for dust containing gases which are taken off during the pushing out of the coke from the coke guide 24. The dust containing gases move through the suction connection 29 as they evolve during the breaking up of the coke cake and coke pieces fall into the tank 2 and are evacuated. The gases pass through the separating and washing equipment 19 where they are washed and cooled with water. Solid particles are precipitated and absorbed by the wash water. An induced draught blower 31 is connected through a bend connection 30 through the separator 19 and is driven by a drive motor 32. The purified gases are evacuated to the outer atmosphere through a sound absorber 33 having a hood portion 34. The spray water for operating the separating and washing means 19 is supplied from tanks (not shown) which connect through a filling connection **33*a*. The water enriched in solid particles and dust passes into the mud collector 34*a* and is evacuated from time to time through the line 35 which includes a valve 36. The control console 37 is located on top of the undercarriage 9. The undercarriage is accessible from a stairway 38 and the upper portion of the hood 5 is accessible through a stairway 39. An inspection window 41 is provided in the hood portion 5.**

Figure 5:
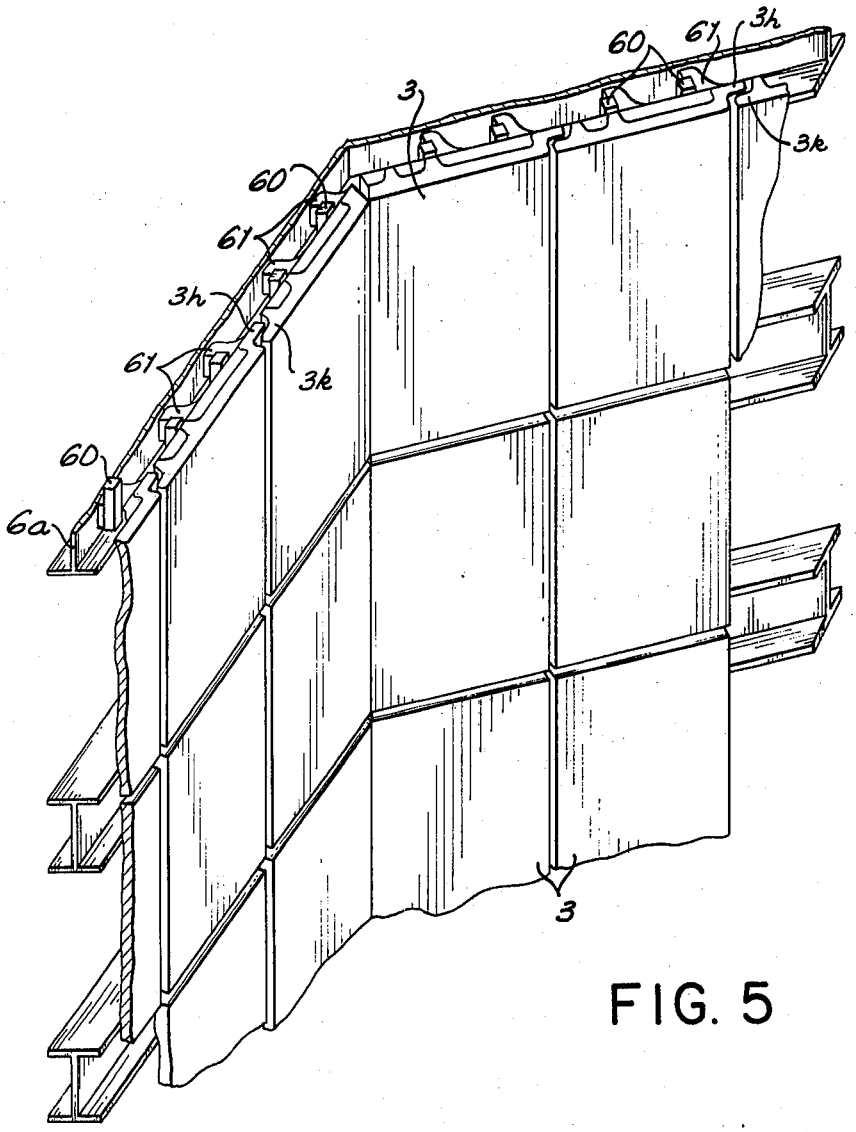
FIG. 5 is an enlarged perspective view of the interior of the tank shown in FIG. 1.

In accordance with a feature of the invention the walls of the coke tank 2 are assembled of individual cast iron plates 3. Plates 3 are loosely suspended in layers from strips which are suspended from the top of the undercarriage 9. The plates 3 are overlapped as shown in FIG. 5 on all of their sides and they include upper overlapping edges **3*h* and lower edges 3*k* which underlap these edges of the next adjacent plates. Heat resistant metal plates 3 are also clamped to the clamping strips or rods 60 in the frame structure 6*a* by means of hook-shaped ribs 6l which are formed on the back of the plates 3. The framed steel structure 6*a* is suspended from the steel frame 7 by means of ears or bolts 8 which are suitably located at spaced locations adjacent the top of the hood portion. The steel frame 7 is supported on top of the undercarriage 9.**

Figure 3:
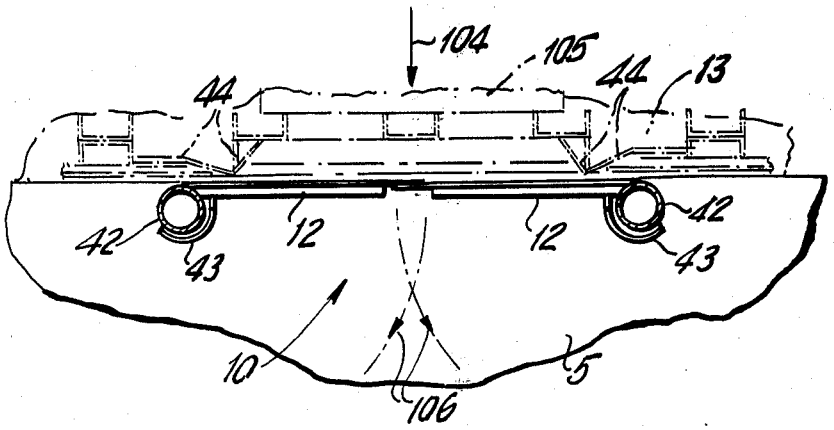
FIG. 3 is an enlarged partial sectional view taken along the line 3—3 of FIG. 1.
Figure 4:
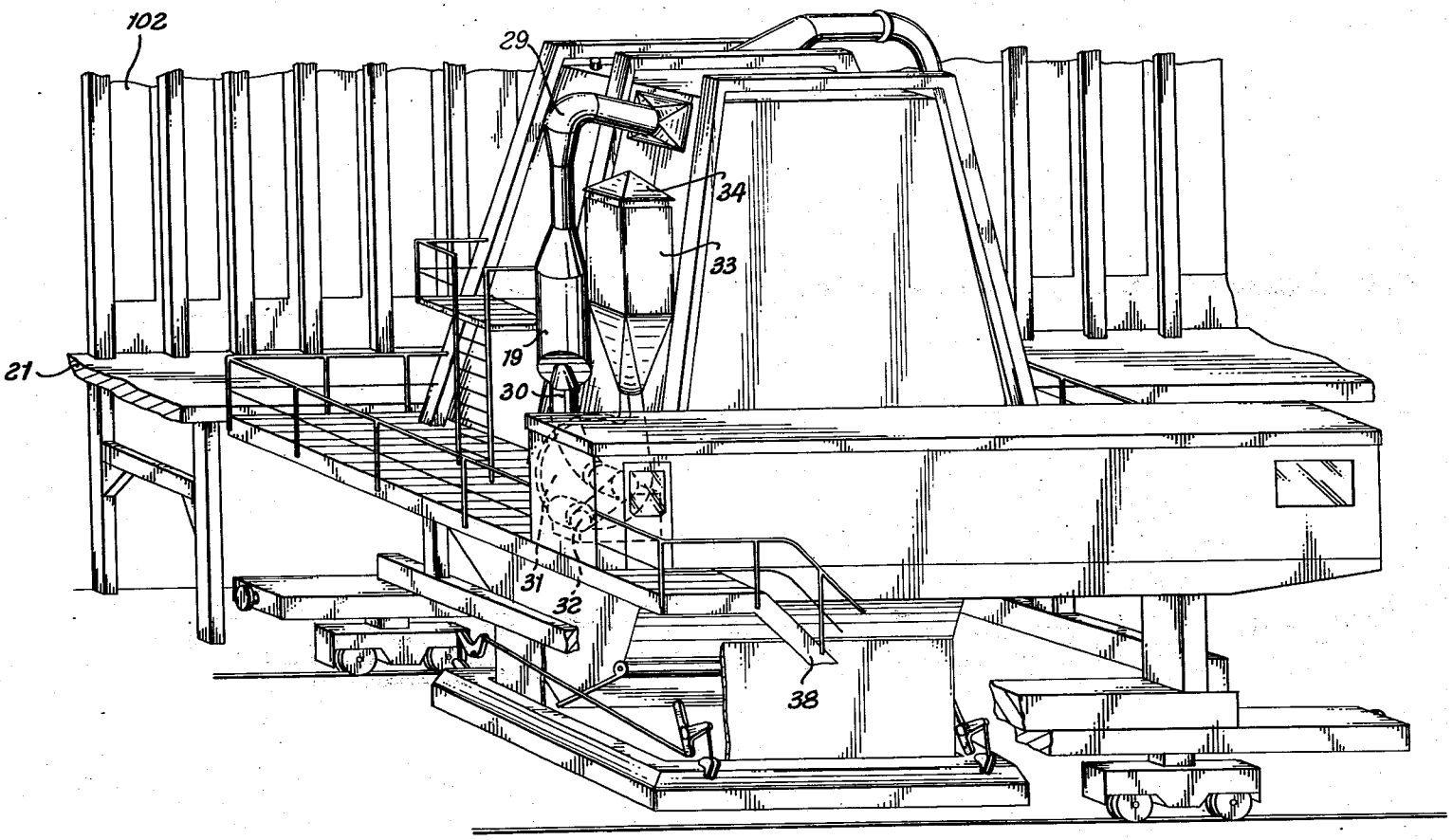
FIG. 4 is a perspective view of the coke oven furnace and tank car shown in FIG. 1.

In accordance with another feature of the invention the hood portion includes a lateral coke entrance opening 10 which may be closed by two door members or wings 12, 12 as shown in FIG. 3. Doors 12 are advantageously biased to a closed position but may be forced inwardly from the coke oven 102 in the direction of the arrow 104 to cause them to swing in the direction of the arrows 106 and to turn them about vertically extending pivot shafts 42, 42. For this purpose the doors 12, 12 may also be driven by drives in the form of a drive motor 11. Each door carries an arcuate shield portion 43 which extends around a major portion of the pivot 42 which is exposed on the interior of the hood portion 5 to protect the pivots 42 from the heat effect of the incandescent coke. Sealing strips 44, 44 are located on each side of an opening 105 of the coke guide 24 and they press into sealing engagement with the hood portion at the shafts 42, 42 when the doors 12, 12 are opened. Sealing strips 44 apply tightly to seal the space between the coke guide 24 and the tank car hood portion 5 during the transfer of the incandescent coke from the guidance carriage into the tank 2.

In accordance with a further feature of the invention the tank 2 has a bottom with a discharge opening 108 which is closed by a cover 14 which is pivotable at one end about a pivot shaft 45 which is journaled for horizontal rotation at the lower end of the tank 2. A hydraulic drive 15 is connected to the cover 14 for opening and closing it in order to effect discharge as desired. Locking means in the form of a locking lever 16 carried on a pivotal shaft 46 is engageable over an end portion **14*a* of the cover 14 to lock it in a closed position. When the locking lever 16 is rotated out of the way by rotation of the shaft 46 to position it in the dotted line position indicated at 16*a* the cover 14 is released so that it may be opened. A fluid drive or similar drive 16*b* is connected to the locking member shaft 46 to pivot it in order to effect locking or unlocking of the lever 16.**

A coke receiving bunker 17 is located alongside the coke oven battery 102, for example midway between the length of the battery of coke ovens so that the tank car may be moved into a position in which the coke may be discharged from the coke tank 2 into the bunker. The bunker is closable by means of a slide cover (not shown).

A channel or trough 47 extends around the periphery of the bunker opening and it is filled with a sealing medium such as water. In accordance with a further feature of the invention the tank car includes a sealing means in the form of a sealing sleeve 48 which surrounds the exterior of the tank 2 around a collar portion **49*a* and it is lowerable by means of a hydraulic drive 54 and linkages 49 to 53 so as to position it into the sealing channel 47. Hydraulic drive 55 directs movement of the mechanical lock 55*a* of the linkage 49 to 53. Thus, the junction between the tank 2** and the coke receiving bunker can be tightly closed to the outside.

Water may be directed through pipes 56 which have nozzles at one end and which are connected to a hydrant. A plow-like distribution arm is arranged within the hood portion 5 and serves for the better distribution of the coke therein.

The operation of the tank car is as follows:

With the lower opening of the tank 2 closed and the door wings 12 of the entrance opening opened the carriage 9 is moved to position the upper hood portion 5 alongside the coke guide car 24. The suction blowers are put into operation and the washing equipment is supplied with water. Thereupon the incandescent coke is filled through the carriage car 24 into the hood portion 5 and into the tank 2. This operation is invisible from the outside and the observer will only recognize some white steam escaping from the chimneys of the suction and washing equipment. After all of the coke charge is received, the door wings 12 are closed and the tank car is moved along its trackway to position it over the bunker 17. In this position for example, fresh water may be supplied to the connection **33*a* and dirty water drained from the tank 34*a*. In the meantime the slide over which is not shown is removed from the top of the bunker and the sealing sleeve 48 is lowered into the sealing channel 47. The locking member 16 is then released. At this stage the hydraulic drive 15 is regulated so that it is without pressure so that the hinged cover will swing downwardly due to the weight of the incandescent coke to discharge it into the receiving bunker 17.** This operation will also be invisible for the observer.

After all of the coke has been discharged into the bunker the suction and washing equipment may be put out of operation and the tank car made ready to receive the next charge of incandescent coke from another oven chamber. The apparatus is advantageously constructed so that each of the steps may be carried out by an automatic operation and control and the movement of the coke during each discharging operation is always through sealed connections so that no dust and contaminants escape to the atmosphere.

While a specific embodiment of the invention has been shown and described in detail to illustrate the application of the principles of the invention, it will be understood that the invention may be embodied otherwise without departing from such principles.

What is claimed is:

1. A closed tank car for receiving and transporting incandescent coke through a coke guide car from the oven chambers of horizontal coke oven batteries to a quenching station, comprising a tank having a hood portion with a lateral coke entrance opening capable of being closed, said entrance opening having the height and width of the coke cake to be received, and adapted to be connected to the coke guide car, said tank having a closeable bottom outlet opening for the coke adapted to be connected to the quenching station, and suction, washing, and separating means for the dusts, gases and fumes produced during the discharge from the oven chambers into the tank car and during the discharge from the tank car into the quenching station connected to said tank, a movable undercarriage, said tank being supported on said movable undercarriage, a tank support frame on said undercarriage, said tank having walls of heat-resistant metal plates which are suspended from said support frame in loosely adjacent layers and overlap one another on all sides, said hood portion comprising a heat-resistant framed steel structure in which said heat-resistant metal plates are arranged in layers and overlapping one another, and strips carried by said support frame secured to said plates.

2. The enclosed tank car according to claim 1, wherein said plates of said tank walls are made of cast iron.

3. The enclosed tank car according to claim 1, wherein said plates are made of hematite and have exterior cooling ribs.

4. The enclosed tank car according to claim 1, wherein said plates of said hood are made of chromium steel alloy containing from 10 to 15 and preferably from 12 to 14% chromium.

5. The enclosed tank car according to claim 1, including a pair of door wings pivotally mounted about vertical pivotal axes on each side of the entrance opening of said hood, said door wings being closable and being adapted to be pushed open by the coke cake when it is discharged from the coke oven.

6. The enclosed tank car according to claim 1, wherein said coke tank is provided with a bottom discharge opening, and hydraulically operatable locking member disposed in said opening and being pivotable out of said opening to open the bottom thereof for the discharge of the coke.

7. The enclosed tank car according to claim 1, wherein said suction washing and separating means includes an induced draft blower for the evacuation of the dust, gases and fumes from the hood portion having a specific suction capacity of from 400 to 600 $Nm^3$ per hour and ton of incandescent coke.

8. The enclosed tank car according to claim 1, including a plow-like distribution arm fixedly located in said tank at a spaced location from the bottom discharge thereof for the guidance of the coke cake.

9. The enclosed tank car according to claim 1, including water pipes provided adjacent said hood having spray nozzles directed toward the interior of said tank and having means thereon for connecting it to a water supply system.

10. A coke oven discharge device for the closed discharge of coke from a horizontal row of coke ovens into a receiving bunker located alongside the ovens, comprising a support frame, track means for guiding said support frame for movement along the rows of ovens and to the receiving bunker, a tank suspended from said frame having a vertically extending hood portion at its top with a lateral receiving opening which is alignable with each oven in succession, openable door means carried by said hood portion for opening and closing said lateral receiving opening, said tank having a bottom with a discharge opening, tank bottom door means carried on said tank for selectively opening and closing said tank bottom discharge for discharging the coke from the tank into the receiving bunker, a seal sleeve carried by said tank and engageable between the exterior of said tank around the discharge thereof and the bunker, and a gas separator and washer connected to said tank for drawing the dust gases and fumes from the coke and for washing them with liquid and separating the solids therefrom, said support frame including a lower carriage frame having wheels comprising said track means, said track means also including tracks defined along the length of the coke oven battery, and a top frame carried on said undercarriage, means on said hood portion suspending said hood portion from said top frame, said tank and said hood portion being made up of a plurality of overlapped steel plates and means for suspending said plates of the hood portion from said top frame.

* * * * *